US006851380B1

(12) United States Patent
Khoury et al.

(10) Patent No.: US 6,851,380 B1
(45) Date of Patent: Feb. 8, 2005

(54) MARINE DOCK HITCH

(75) Inventors: George Michael Khoury, Miami, FL (US); Conrad Nels Petersen, Ft. Meyers, FL (US)

(73) Assignee: Marine Dockhitch Corporation, Miami, FL (US)

( * ) Notice: Subject to any disclaimer, the term of this patent is extended or adjusted under 35 U.S.C. 154(b) by 0 days.

(21) Appl. No.: 10/719,967

(22) Filed: Nov. 21, 2003

(51) Int. Cl.[7] ..... B63B 21/00
(52) U.S. Cl. ..... 114/230.15
(58) Field of Search ..... 114/230.15–230.19, 114/230, 250, 219, 218

(56) References Cited

U.S. PATENT DOCUMENTS 4,144,831 A * 3/1979 Heydolph ..... 114/230.18
4,708,083 A * 11/1987 Billings ..... 114/230.17
5,499,591 A * 3/1996 Chippas ..... 114/230.15

* cited by examiner

*Primary Examiner*—Ed Swinehart
(74) *Attorney, Agent, or Firm*—Gold & Rizvi, P.A.; H. John Rizvi; Glenn E. Gold

(57) ABSTRACT

A marine dock hitch which is designed to facilitate the quick and convenient attachment of a boat to a dock, facilitates locking of the boat to the dock to prevent theft of the boat, and provides a resilient connection between the boat and the dock to accommodate considerable elevation changes in the tide and wave action of a water body while the boat is attached to the dock. The marine dock hitch includes an elongated hitch bar having a hitch coupling provided on each end. One of the hitch couplings is removably attached to a hitch catch provided on the dock, and the other of the hitch couplings is removably attached to a hitch catch provided on the boat.

14 Claims, 7 Drawing Sheets

MARINE DOCK HITCH

BACKGROUND OF THE INVENTION

1. Field of the Invention

The present invention generally relates to marine hitch devices for hitching a boat to a dock, and more particularly, to a marine dock hitch which provides a quick and convenient manner of hitching a boat to a dock. The marine dock hitch is capable of maintaining a secure connection between a boat and a dock throughout rising and falling tides in a water body.

2. Description of the Prior Art

In recent years, boating has become an increasingly popular pastime in the United States. Millions of people each year use watercraft of various size and description to water ski, fish and cruise on a lake or other water body. Popular watercraft vary in size from the smaller jet skis and "waverunners" to larger ski boats and fishing boats, such as bay boats, which are designed for deep-sea fishing.

Other common pastimes which are frequently associated with boating include camping, hiking and picknicking. Many people enjoy spending the morning cruising, fishing or skiing on a lake or other water body in a watercraft, after which they dock the craft at a docking facility and have a picnic or go hiking on land, for example. Frequently, after a day of boating, the craft is docked overnight at a public or private docking facility.

Various techniques have been used to attach a boat to a lakeside or seaside dock. These techniques include relatively simple approaches, such as tying the boat to the dock and hanging tires over the edge of the boat to cushion and prevent damage to the boat. More sophisticated approaches include the use of a rope or ropes in conjunction with specially-designed plastic, rubber or inflatable bumpers to cushion the boat. In either method, one end of a rope is typically tied to or looped around a rail or other structure on the boat. One or both ends of the rope are tied to a structure on the dock.

The aforementioned approaches to docking a boat are attended by numerous disadvantages. First, suitable structures on the boat and dock must be identified prior to attaching the boat to the dock. In some cases, the boat may not include a suitable structure for secure attachment to the dock using ropes. Second, the rope or ropes which attach the boat to the dock need only be untied for thieves to steal the boat. Third, the wave action of the water body on which the boat floats may raise and lower the boat considerably. Consequently, the ropes may exert a considerable strain on the rails or other structure in the boat to which the ropes are tied.

There is therefore an established need for a marine dock hitch which provides a quick and convenient mechanism for removably attaching a boat to a docking facility; provides a mechanism for locking the boat to the docking facility to prevent theft of the boat; and accommodates considerable changes in the tides or wave action of a water body on which the boat floats.

SUMMARY OF THE INVENTION

The present invention is directed to a marine dock hitch which is designed to facilitate the quick and convenient attachment of a boat to a dock, facilitates locking of the boat to the dock to prevent theft of the boat, and provides a resilient connection between the boat and the dock to accommodate considerable elevation changes in the tide and wave action of a water body while the boat is attached to the dock. The marine dock hitch includes an elongated hitch bar having a hitch coupling provided on each end. One of the hitch couplings is removably attached to a hitch catch provided on the dock, and the other of the hitch couplings is removably attached to a hitch catch provided on the boat.

An object of the present invention is to provide a marine dock hitch which facilitates quick, convenient and secure connection between a boat and a dock.

Another object of the present invention is to provide a marine dock hitch that may be used to connect boats of various size and description to a docking facility.

Still another object of the present invention is to provide a marine dock hitch that is capable of locking a boat to a dock to prevent theft of the boat.

Yet another object of the present invention is to provide a marine dock hitch which is capable of accommodating the rising and falling tidal and wave action of a water body on which a boat floats to securely dock the boat to a docking facility.

A still further object of the present invention is to provide a marine dock hitch that maintains a docked boat at a safe distance from a dock to prevent striking of the boat against the dock during adverse weather conditions, strong winds and changing tides.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Shown throughout the drawings, the present invention is generally directed towards a marine dock hitch that is capable of quickly, conveniently and securely connecting a boat to a dock while permitting locking of the boat to the dock and accommodating the rising and falling action of tides and waves in a water body on which the boat floats.

Figure 1:
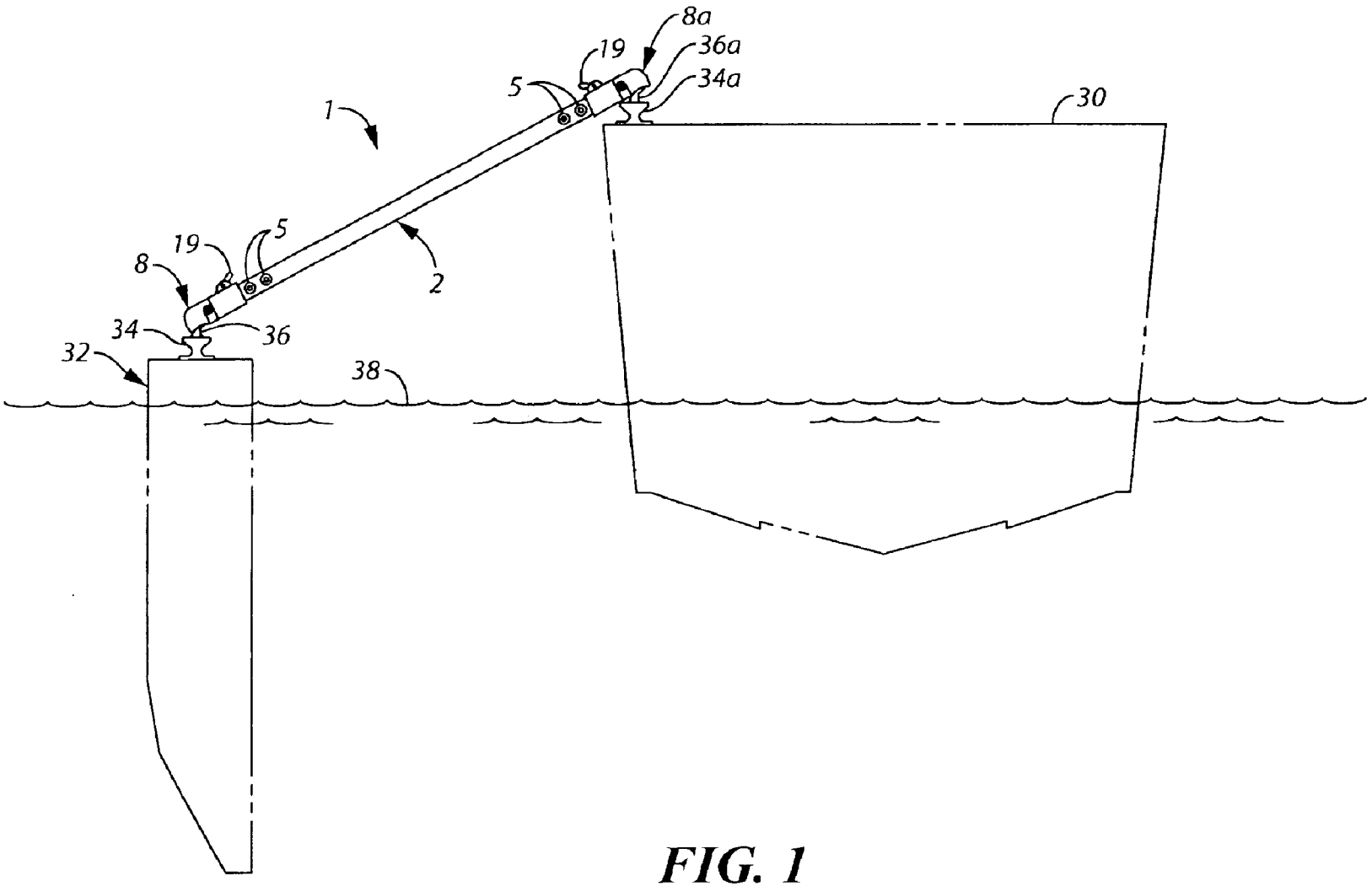
FIG. 1 is an end view of a boat (in phantom) floating on a water body in high tide and attached to a dock (in phantom), with a preferred embodiment of the marine dock hitch of the present invention shown connecting the boat to the dock.
Figure 2:
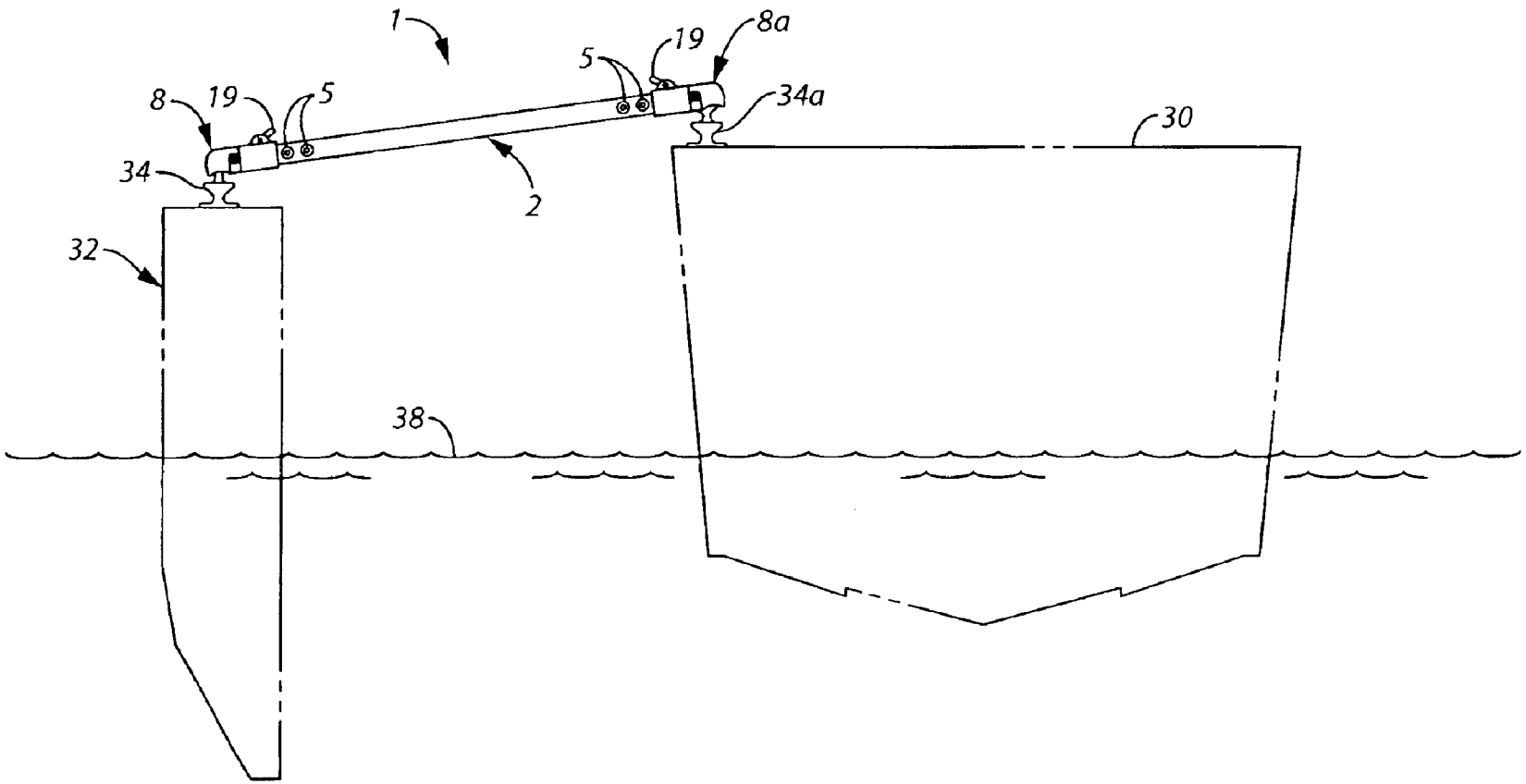
FIG. 2 is an end view of a boat (in phantom) floating on a water body in low tide and attached to a dock (in phantom), with the marine dock hitch of the present invention shown connecting the boat to the dock.

Referring initially to FIGS. 1–8, a preferred embodiment of the marine dock hitch of the present invention is generally indicated by reference numeral 1. As illustrated in FIGS. 1 and 2, the marine dock hitch 1 includes an elongated hitch bar 2, which may be steel or aluminum square tubing, for example. A hitch coupling 8 and a hitch coupling 8*a*, which may be substantially similar or identical in construction, are provided on respective ends of the hitch bar 2.

In use of the marine dock hitch 1, which will be hereinafter further described, the hitch coupling 8 engages a hitch catch 36 provided on a hitch catch mount 34 which is mounted on a dock 32. The hitch coupling 8*a* engages a similar or identical hitch catch 36*a* provided on a hitch catch mount 34*a* which is mounted on a boat 30 floating on a water body 38. The marine dock hitch 1 couples the boat 30 to the dock 32 while preventing inadvertent striking of the boat 30 against the dock 32 during high winds, adverse weather conditions and/or rising and falling tidal or wave action in the water body 38, for example.

Figure 6:
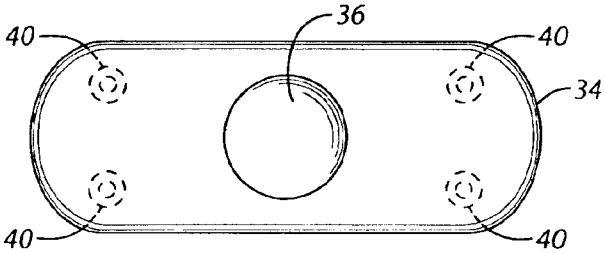
FIG. 6 is a top view of a hitch catch mount and hitch catch used to attach one end of the marine dock hitch to a dock or boat.
Figure 7:
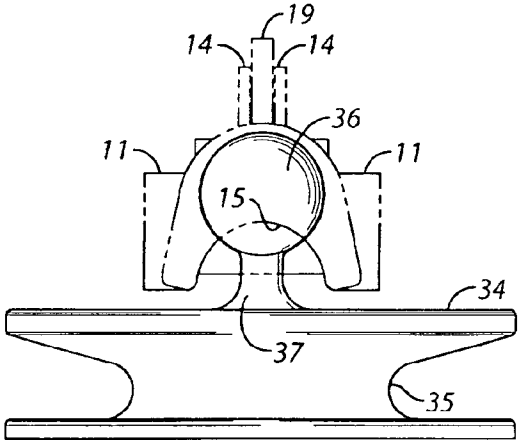
FIG. 7 is a front view of a hitch catch mount and hitch catch (in solid lines), with a hitch coupling (in phantom) on one end of the marine dock hitch removably coupled to the hitch catch.
Figure 8:
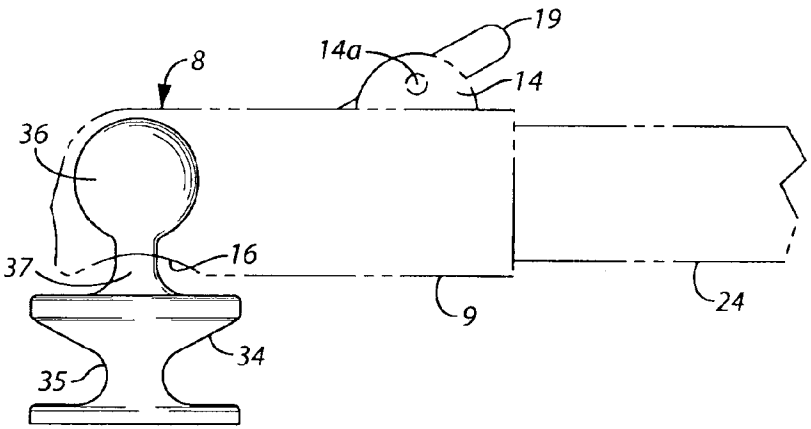
FIG. 8 is a side view of a hitch catch mount and hitch catch (in solid lines), with a hitch coupling (in phantom) on one end of the marine dock hitch removably coupled to the hitch catch.

The hitch catch mount 34 and hitch catch 36 mounted on the dock 32 may be substantially similar or identical in construction with respect to the hitch catch mount 34*a* and hitch catch 36*a*, respectively, mounted on the boat 30. As illustrated in FIGS. 6–8, the hitch catch 36 extends upwardly from the hitch catch mount 34. The hitch catch mount 34 may be provided with a rope groove 35 to facilitate the tying of a rope to and/or wrapping of a rope around the hitch catch mount 34, as deemed necessary.

As illustrated in FIG. 6, the hitch catch mount 34 is mounted on the dock 32 (FIG. 1) typically by extending multiple mount bolts 40 through respective bolt openings (not shown) provided in the hitch catch mount 34 and threading the mount bolts 34 into respective registering bolt openings (not shown), provided in the dock 32. The hitch catch mount 34*a* may be mounted on the deck of the boat 30 in similar fashion. However, it is understood that the hitch catch mount 34 and hitch catch mount 34*a* may be mounted to the dock 34 and boat 30, respectively, using any suitable alternative technique known to those skilled in the art.

Figure 4:
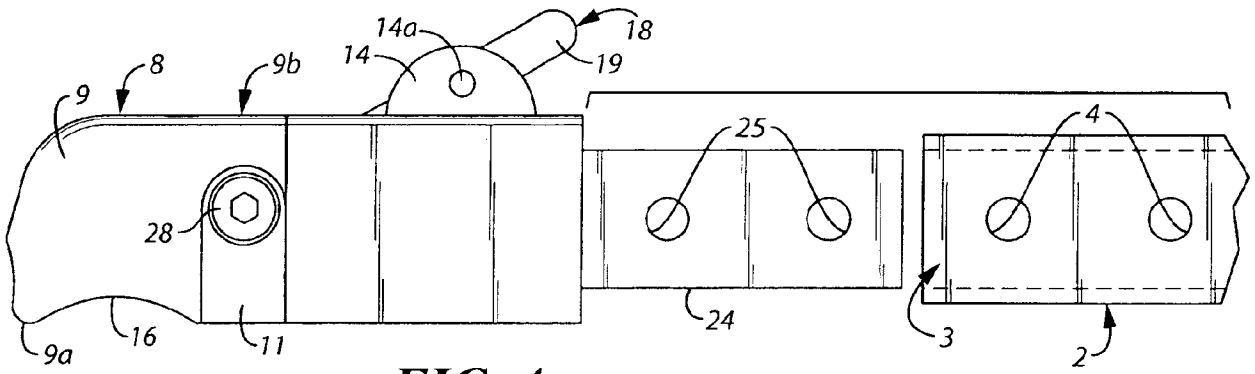
FIG. 4 is a side view, partially in section, of a hitch coupling on one end of the marine dock hitch.
Figure 3:
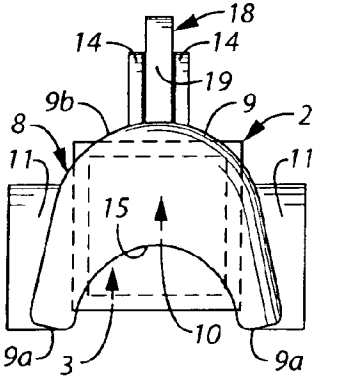
FIG. 3 is a front end view of a hitch coupling element of the marine dock hitch.
Figure 5:
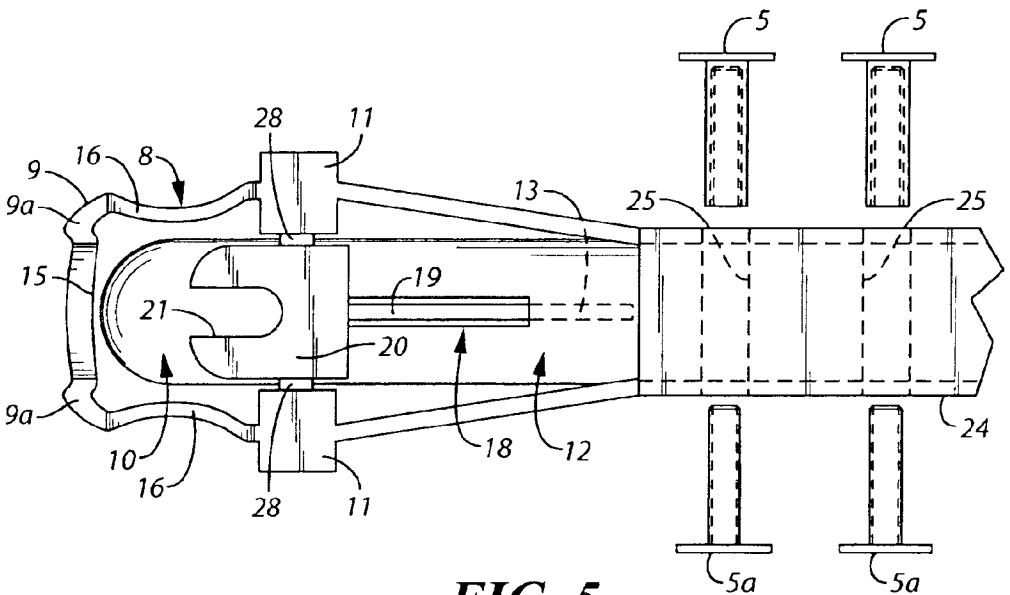
FIG. 5 is a bottom exploded view, partially in section, of a hitch coupling on one end of the marine dock hitch.

Because the construction of the hitch coupling 8 and hitch coupling 8*a* may be substantially similar or identical, description of the hitch coupling 8 with respect to FIGS. 3–8 herein below may apply as well to the hitch coupling 8*a*. As illustrated in FIG. 4, the hitch coupling 8 includes an elongated housing 9, which may be steel or aluminum, for example. As illustrated in FIG. 5, the housing 9 includes a housing interior 12, the front end of which is shaped to define a generally spherical catch receptacle 10. A generally curved or arcuate front housing notch 15 is provided in the bottom edge 9*a* of the housing 9, at the front of the hitch coupling 8, as shown in FIGS. 3 and 5. A generally curved or arcuate side housing notch 16 is likewise provided in the bottom edge 9*a* of the housing 9, at both sides of the hitch coupling 8, as shown in FIGS. 3–5.

Bolt receptacles 11 are provided on opposite sides of the housing 9 for purposes which will be hereinafter described. An elongated lock slot 13 (FIG. 5) extends through the upper surface 9*b* of the housing 9. As illustrated in FIGS. 3 and 4, a pair of lock flanges 14 extends upwardly from the upper surface 9*b* of the housing 9. A lock opening 14*a* extends through each of the lock flanges 14, with the lock openings 14*a* of the respective lock flanges 14 disposed in registering relationship to each other.

As further shown in FIGS. 3–5, each of the hitch couplings 8 and 8*a* typically includes a lock handle 18. The lock handle 18 includes an elongated handle shaft 19, the lower end of which terminates in a lock flange 20, as shown in FIG. 5. The lock flange 20 includes a central flange slot 21. In assembly, the handle shaft 19 of the lock handle 18 is inserted through the lock slot 13, with the lock flange 20 positioned inside the catch receptacle 10. A shoulder bolt 28 is extended through the aligned bolt receptacles 11 on the housing 9, and through a registering bolt opening (not shown) which extends through the lock flange 20. The shoulder bolt 28 is secured typically with a nut (not shown) to pivotally mount the lock handle 18 in the housing interior 12.

In use of the marine dock hitch 1 as hereinafter further described, the lock handle 18 is pivotal between an "unlock" position, in which the lock flange 20 extends downwardly from the catch receptacle 10, and a "lock" position, in which the lock flange 20 is disposed in a raised position in the catch receptacle 10. When the lock handle 18 is in the "unlock" position, the handle shaft 19 extends above the registering lock openings 14*a* in the lock flanges 14. Conversely, when the lock handle 18 is in the "lock" position, the handle shaft 19 is positioned between the lock flanges 14, with the aligned lock openings 14*a* registering with a lock opening (not shown) extending through the handle shaft 19.

When the lock handle 18 is in the "unlock" position, the lock flange 20 clears the bottom opening of the catch receptacle 10 such that the hitch coupling 8 can be lowered in place onto the hitch catch 36. The lock handle 18 is then pivoted to the "lock" position such that the flange opening 21 of the lock flange 20 receives a hitch catch shaft 37 (FIGS. 7 and 8) and the lock flange 20 engages the base of the hitch catch 36. A padlock or other locking mechanism (not shown) may be extended through the registering lock openings 14*a* in the adjacent lock flanges 14, and through the registering lock opening (not shown) provided in the handle shaft 19 of the lock handle 18, to lock the hitch coupling 8 on the hitch catch 36.

A coupling arm 24, which may be aluminum or steel square tubing, for example, extends from the rear end of the housing 9 of both the hitch coupling 8 and the hitch coupling 8*a*. Multiple, spaced-apart bolt openings 25 extend laterally through the coupling arm 24. As illustrated in FIG. 4, the hitch bar 2 typically has a hollow hitch bar interior 3. Accordingly, in assembly of the marine dock hitch 1, the coupling arm 24 of the hitch coupling 8 is inserted in the hitch bar interior 3 at one end of the hitch bar 2, whereas the coupling arm 24 of the hitch coupling 8*a* is inserted in the hitch bar interior 3 at the opposite end of the hitch bar 2.

As further shown in FIG. 4, multiple bolt openings 4 extend laterally through the hitch bar 2 and correspond to the positions of the respective bolt openings 25 in the coupling arm 24. After the coupling arm 24 is inserted in the hitch bar interior 3 of the hitch bar 2, a pair of interiorly-threaded bolt receptacles 5 (FIG. 5) is typically extended through the respective bolt openings 4 in the hitch bar 2 and through the registering bolt openings 25 in the coupling arm 24. Mount bolts 5*a* are threaded into the respective bolt receptacles 5 to removably mount the hitch couplings 8 and 8*a* on the hitch bar 2. It is understood that the hitch couplings 8, 8*a* may be removably mounted on the respective ends of the hitch bar 2 using any suitable alternative technique known by those skilled in the art, or may be fixedly mounted on the hitch bar 2, as desired.

Figure 9:
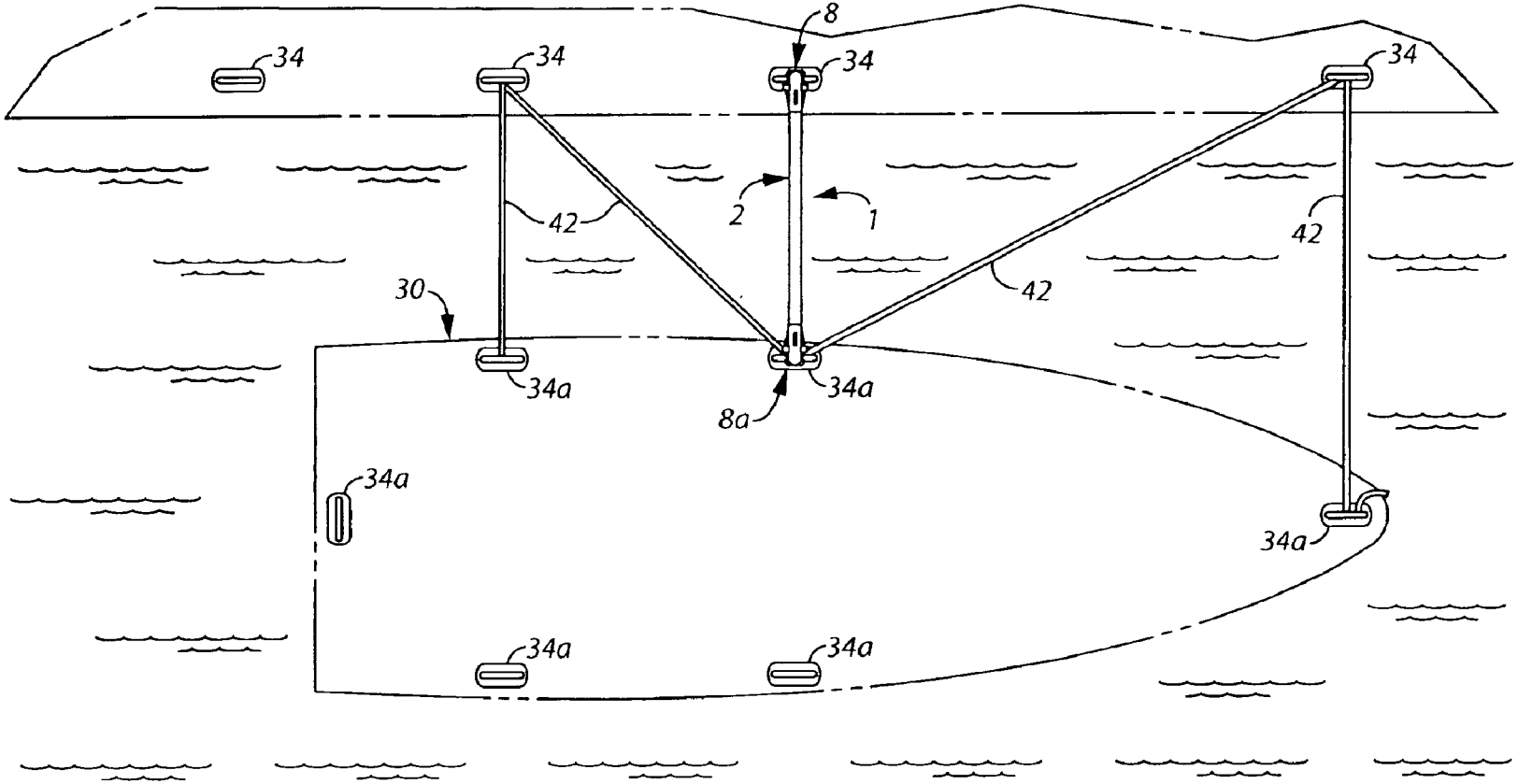
FIG. 9 is a top view of a boat floating on a water body and connected to a dock using the marine dock hitch of the present invention, in conjunction with multiple ropes.

Referring next to FIGS. 1, 2, 7–9 and 10, in application the marine dock hitch 1 may be used to couple a boat 30 to a dock 32, typically in conjunction with one or multiple ropes 42, as illustrated in FIG. 9. Accordingly, the hitch coupling 8 of the marine dock hitch 1 is initially coupled to the hitch catch 36 provided on the hitch catch mount 34. With the lock handle 18 (FIGS. 4 and 5) in the "unlock" position, this is accomplished by initially lowering the housing 9 of the hitch coupling 8 over the hitch catch 36, such that the hitch catch 36 extends upwardly into the catch receptacle 10 (FIG. 5) inside the housing 9, as shown in FIGS. 7 and 8. Next, the lock handle 18 is manipulated to the "lock" position, wherein the handle shaft 19 is pushed downwardly to extend between the lock flanges 14 and the lock flange 20 is raised to engage the base of the hitch catch 36. A padlock (not shown) may then be extended through the lock openings 14*a* of the respective lock flanges 14, to lock the hitch coupling 8 on the hitch catch 36. The hitch coupling 8*a* of the marine dock hitch 1 is then coupled to the hitch catch 36*a* on the hitch catch mount 34*a* on the boat 30, in similar fashion, to couple the boat 30 to the dock 32.

Figure 10:
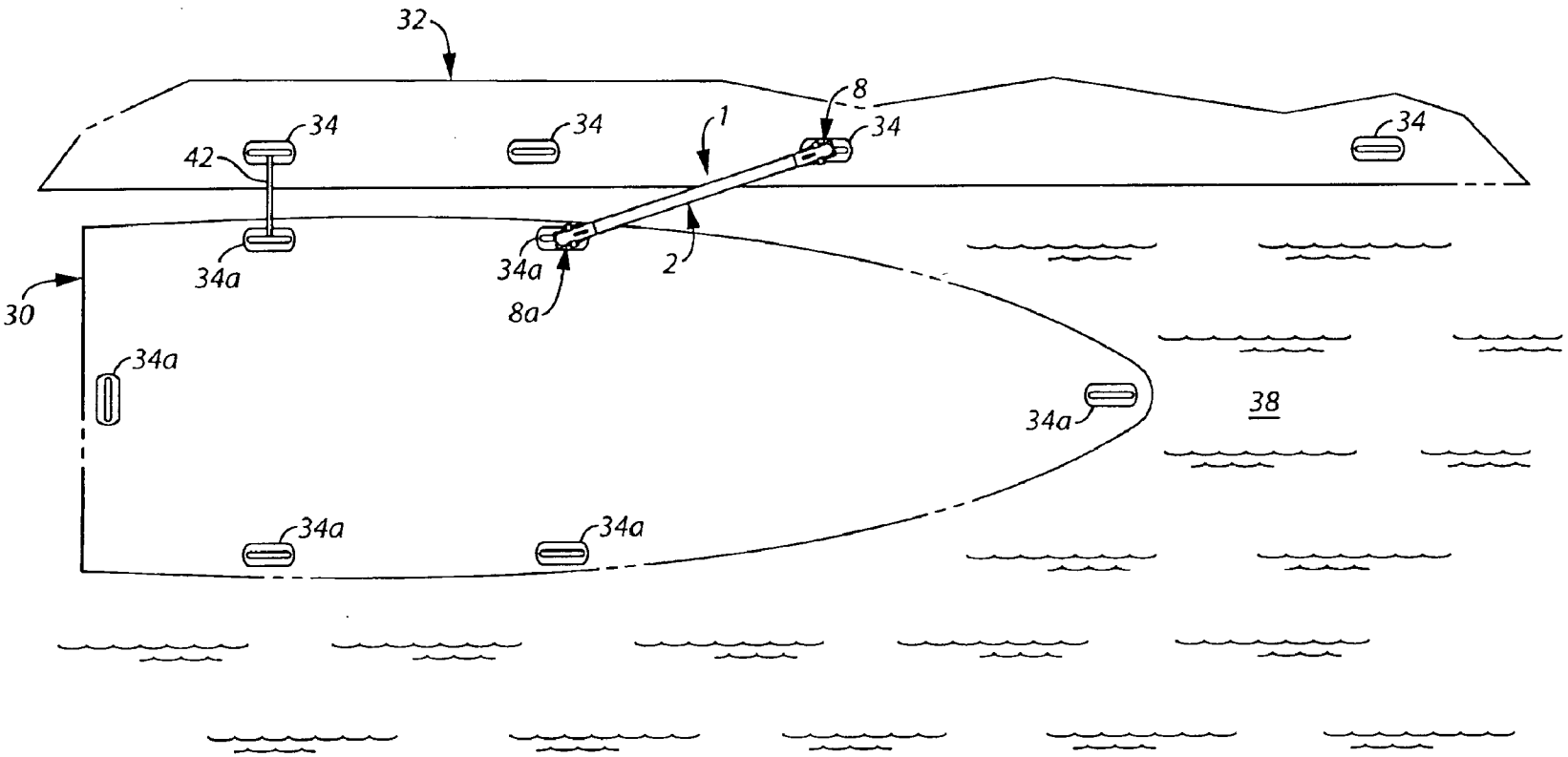
FIG. 10 is a top view of a boat floating on a water body and connected to a dock using the marine dock hitch of the present invention, with the boat in a board/unboard configuration.

As illustrated in FIG. 10, after the marine dock hitch 1 is locked in place as heretofore described, the boat 30 may be positioned adjacent to the dock 32 for boarding and unboarding or embarking and disembarking of the boat 30. A rope or ropes 42 may be used to additionally secure the boat 30 adjacent to the dock 32 during loading and unloading. It will be appreciated by those skilled in the art that the hitch couplings 8, 8*a* pivot with respect to the respective hitch catches 36, 36*a* to which they are attached to permit positioning of the boat 30 adjacent to the dock 32.

As illustrated in FIG. 9, the boat 30, coupled to the dock 32 using the marine dock hitch 1, may be stabilized in a position away from the dock 32 to prevent inadvertent striking of the boat 30 against the dock 32 during high winds, adverse weather conditions and/or rising and falling tidal and wave action of the water body 38, for example. This may be accomplished by tying one end of a rope 42 to a hitch catch mount 34*a* or other element on the boat 30 which is located to one side of the marine dock hitch 1; extending the rope 42 around a hitch catch mount 34 or other element on the dock 32; extending the rope 42 around the hitch catch mount 34*a* having the hitch catch 36*a* to which the hitch coupling 8*a* of the marine dock hitch 1 is coupled; extending the rope 42 around a second hitch catch mount 34 or other element on the dock 32; and tying the rope 42 to a hitch catch mount 34*a* provided on the boat 30, on the opposite side of the marine dock hitch 1. However, it is understood that the rope configuration of FIG. 9 is exemplary and that a variety of other rope configurations may be used to stabilize the boat 30 with respect to the dock 32.

As illustrated in FIGS. 1 and 2, in which the rope 42 shown in FIG. 9 has been omitted for clarity, it will be appreciated by those skilled in the art that the marine dock hitch 1 is capable of accommodating rising and falling tidal and wave action of a water body 38 on which the boat 30 floats. For example, in FIG. 1, the water body 38 is at a high level, whereas in FIG. 2, the water body 38 is at a low level. Due to the curved front housing notch 15 (FIGS. 3 and 5) and side housing notches 16 (FIGS. 4 and 5) in the housing 9 of each of the hitch couplings 8, 8*a*, the hitch couplings 8, 8*a* are capable of maintaining a secure and yet resilient connection with the respective hitch catches 36, 36*a* during the rising and falling tidal and wave action.

Figure 11:
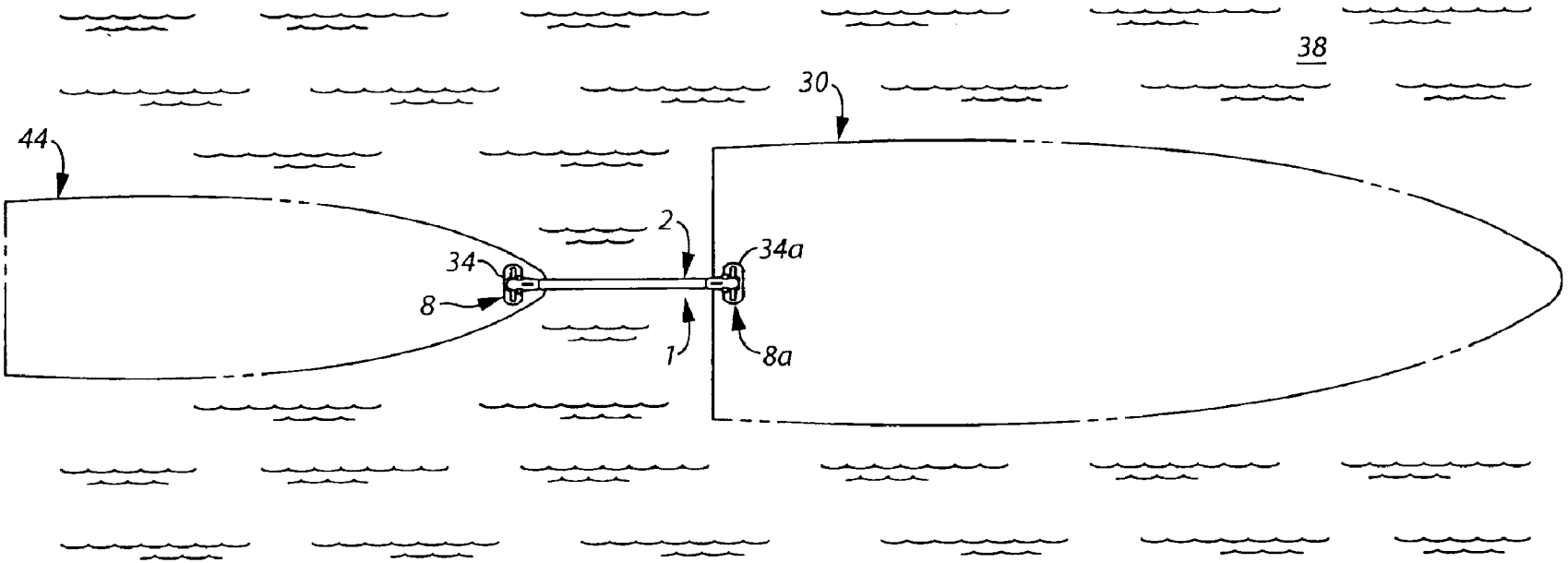
FIG. 11 is a top view of a towing boat connected to a towed boat using the marine dock hitch in a towing application of the invention.

An alternative application of the marine dock hitch 1 is shown in FIG. 11, wherein the marine dock hitch 1 connects a first boat 30 to a second boat 44 for towing of the second boat 44 by the first boat 30. Accordingly, the hitch coupling 8 of the marine dock hitch 1 is coupled to the hitch catch 36 on the towed boat 44, and the opposite hitch coupling 8*a* of the marine dock hitch 1 is coupled to the hitch catch 36*a* on the towing boat 30. Due to the capability of the hitch couplings 8, 8*a* to pivot in both a horizontal plane and a vertical plane with respect to the respective hitch catches 36, 36*a* to which they are coupled, the marine dock hitch 1 provides a secure and yet resilient connection between the boats 30, 44 throughout the towing operation.

Referring again to FIG. 9, when it is desired to uncouple the boat 30 from the dock 32 for an excursion in the boat 30, for example, the ropes 42 are untied from the respective hitch catch mounts 34*a* on the boat 30 and unwound from the hitch catch mounts 34 on the dock 32; the hitch coupling 8 is removed from the hitch catch 36 on the dock 32 by unlocking the lock handle 18 (FIGS. 4 and 5) and manipulating the lock handle 18 to the "open" position; and the hitch coupling 8 is lifted from the hitch catch 36. The hitch coupling 8*a* may remain attached to the hitch catch 36*a* on the boat 30, in which case the hitch bar 2 can be pivoted to rest on the deck of the boat 30. Alternatively, the hitch coupling 8*a* can be unlocked and removed from the hitch catch 36*a* on the boat 30, in which case the hitch coupling 8 may remain attached to the hitch catch 36 on the dock 32.

While the preferred embodiments of the invention have been described above, it will be recognized and understood that various modifications can be made in the invention and the appended claims are intended to cover all such modifications which may fall within the spirit and scope of the invention.

What is claimed is:

1. A marine dock hitch for coupling a boat to a dock, comprising:

a generally elongated hitch bar;

a first hitch coupling having a first housing provided on a first end of said hitch bar for removably engaging the dock; and a second hitch coupling having a second housing provided on a second end of said hitch bar for removably engaging the boat, said first housing and said second housing each having a bottom edge and a plurality of generally curved notches provided in said bottom edge.

2. The marine dock hitch of claim 1 further comprising a first hitch catch for attachment to the dock and a second hitch catch for attachment to the boat, and wherein said first housing is adapted for removably engaging said first hitch catch and said second housing is adapted for removably engaging said second hitch catch.

3. The marine dock hitch of claim 1 further comprising a locking mechanism carried by each of said first hitch coupling and said second hitch coupling for removably locking said first hitch coupling to the dock and said second hitch coupling to the boat, respectively.

4. The marine dock hitch of claim 3 further comprising a first hitch catch for attachment to the dock and a second hitch catch for attachment to the boat, and wherein said first housing is adapted for removably engaging said first hitch catch and said second housing is adapted for removably engaging said second hitch catch.

5. The marine dock hitch of claim 2 wherein said first housing and said second housing each comprises a catch receptacle for receiving said first hitch catch and said second hitch catch, respectively.

6. The marine dock hitch of claim 5 further comprising a locking mechanism carried by each of said first hitch coupling and said second hitch coupling for removably locking said first hitch coupling to said first hitch catch and said second hitch coupling to said second hitch catch.

7. The marine dock hitch of claim 3 wherein said locking mechanism comprises a lock handle pivotally carried by said first hitch coupling and said second hitch coupling, respectively, for removably engaging the dock and the boat, respectively.

8. The marine dock hitch of claim 7 further comprising a first hitch catch for attachment to the dock and a second hitch catch for attachment to the boat, and wherein said first housing is adapted for removably engaging said first hitch catch and said second housing is adapted for removably engaging said second hitch catch.

9. The marine dock hitch of claim 8 wherein said first housing and said second housing each comprises a catch receptacle for receiving said first hitch catch and said second hitch catch, respectively.

10. A marine dock hitch for coupling a boat to a dock, comprising:

a first hitch catch mount having a first hitch catch for attachment to the dock;

a second hitch catch mount having a second hitch catch for attachment to the boat;

a generally elongated hitch bar;

a first hitch coupling provided on a first end of said hitch bar for removably engaging said first hitch catch;

a second hitch coupling provided on a second end of said hitch bar for removably engaging said second hitch catch, said first hitch coupling and said second hitch coupling each comprising a housing having a bottom edge and a catch receptacle for receiving said first hitch catch and said second hitch catch, respectively; and a generally curved front housing notch and a pair of generally curved side housing notches provided in said bottom edge of said housing.

11. The marine dock hitch of claim 10 further comprising a locking mechanism carried by each of said first hitch coupling and said second hitch coupling for removably locking said first hitch coupling to said first hitch catch and said second hitch coupling to said second hitch catch, respectively.

12. The marine dock hitch of claim 11 wherein said locking mechanism comprises a lock handle pivotally carried by said first hitch coupling and said second hitch coupling, respectively, for removably engaging said first hitch catch and said second hitch catch, respectively.

13. A marine dock hitch for coupling a boat to a dock, comprising:

a first hitch catch mount having a first hitch catch for attachment to the dock;

a second hitch catch mount having a second hitch catch for attachment to the boat;

a rope groove provided in each of said first hitch catch mount and said second hitch catch mount;

a generally elongated hitch bar;

a first hitch coupling having a first housing provided on a first end of said hitch bar for removably receiving said first hitch catch;

a second hitch coupling having a second housing provided on a second end of said hitch bar for removably receiving said second hitch catch; and a lock handle pivotally carried by said first hitch coupling and said second hitch coupling, respectively, for removably engaging said first hitch catch and said second hitch catch, respectively.

14. The marine dock hitch of claim 13 wherein said first housing and said second housing each comprises a bottom edge and further comprising a generally curved front housing notch and a pair of generally curved side housing notches provided in said bottom edge.

* * * * *